United States Patent [19]

Maskasky

[11] Patent Number: 4,684,607

[45] Date of Patent: Aug. 4, 1987

[54] TABULAR SILVER HALIDE EMULSIONS WITH LEDGES

[75] Inventor: Joe E. Maskasky, Rochester, N.Y.

[73] Assignee: Eastman Kodak Company, Rochester, N.Y.

[21] Appl. No.: 904,737

[22] Filed: Sep. 8, 1986

[51] Int. Cl.[4] ..... G03C 1/02

[52] U.S. Cl. ..... 430/567; 430/569

[58] Field of Search ..... 430/567

[56] References Cited

U.S. PATENT DOCUMENTS

| | | | |
|---|---|---|---|
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,304 | 11/1983 | Dickerson | 430/353 |
| 4,414,306 | 11/1983 | Wey et al. | 430/434 |
| 4,414,310 | 11/1983 | Daubendiek et al. | 430/567 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/567 |
| 4,435,501 | 3/1984 | Maskasky | 430/434 |
| 4,439,520 | 3/1984 | Kofron et al. | 430/434 |
| 4,478,929 | 10/1984 | Jones et al. | 430/217 |
| 4,504,570 | 3/1985 | Evans et al. | 430/217 |

FOREIGN PATENT DOCUMENTS

| | | | |
|---|---|---|---|
| 2905655 | 8/1979 | Fed. Rep. of Germany | 430/567 |

OTHER PUBLICATIONS

Research Disclosure, vol. 232, Aug. 1983, Item 23212.
Research Disclosure, vol. 225, Jan. 1983, Item 22534.

*Primary Examiner*—Richard L. Schilling
*Assistant Examiner*—Patrick Doody
*Attorney, Agent, or Firm*—Carl O. Thomas

[57] ABSTRACT

A photographic emulsion is disclosed containing tabular silver halide grains having opposed major faces and ledges of relatively reduced thickness extending laterally beyond at least one of said major faces.

20 Claims, 12 Drawing Figures

FIG. 3
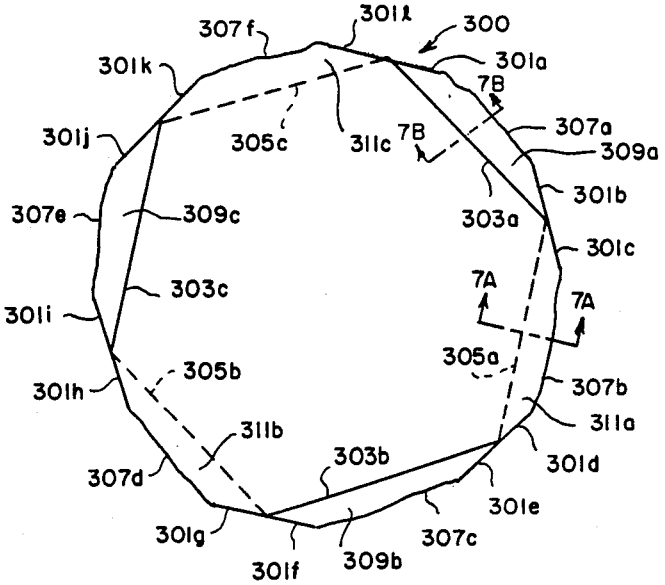
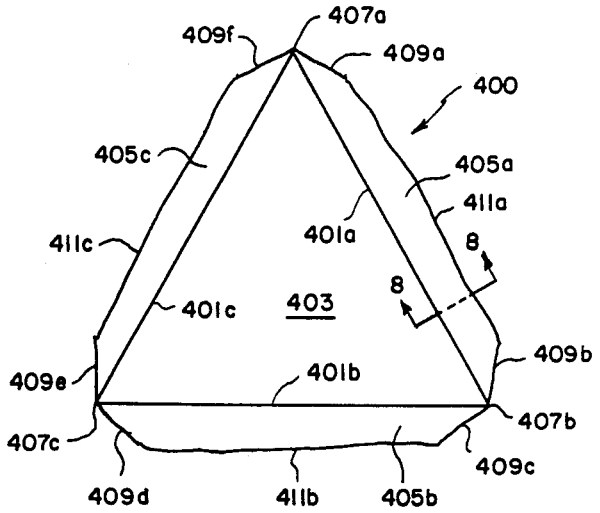
FIG. 4

1μm

1μm

1 μm

1 μm

TABULAR SILVER HALIDE EMULSIONS WITH LEDGES

FIELD OF THE INVENTION

This invention relates to photographic emulsions. More specifically, the invention relates to tabular grain silver halide emulsions.

BACKGROUND OF THE INVENTION

Photographic silver halide emulsions are dispersions of radiation sensitive silver halide microcrystals, referred to as grains, capable of forming a latent image. Photographic silver halides exclude silver fluoride, which is water soluble, and silver iodide, which, though highly useful in minor proportions, as a major grain component does not efficiently form developable latent images. Although photographic silver halide emulsions prepared by single jet precipitation techniques have been long known to contain some tabular grains, the photographic advantages offered by the presence of tabular grains in silver halide emulsions was not appreciated until relatively recently.

Depending upon the intended photographic application and the halide content of the tabular grains, tabular grain emulsions have been recently disclosed in which tabular grains of (i) 0.5 micrometer (hereinafter designated μm) or less in thickness, more typically 0.3 μm or less in thickness, and optimally less than 0.2 μm in thickness (ii) having an average aspect ratio of at least 5:1, more typically greater than 8:1, and (iii) accounting for greater than 35 percent, more typically greater than 50 percent, of the total grain projected area of the emulsion have been disclosed. Disclosed advantages have included increased speed, improved developability, improved speed-granularity relationships, increased sharpness, increased blue and minus blue speed separations, higher developed silver covering power of fully forehardened emulsions, reduced crossover in dual coated radiographic elements, higher transferred image densities at reduced silver coverages in image transfer photography, and reduced thermal variance and rereversal in direct reversal applications. Illustrative of high and intermediate aspect ratio tabular grain emulsions, their methods of preparation, and their photographic advantages are the following:

(T-1) Wilgus et al U.S. Pat. No. 4,434,226,
(T-2) Kofron et al U.S. Pat. No. 4,439,520,
(T-3) Daubendiek et al U.S. Pat. No. 4,414,310,
(T-4) Abbott et al U.S. Pat. No. 4,425,425,
(T-5) Wey U.S. Pat. No. 4,399,215,
(T-6) Solberg et al U.S. Pat. No. 4,433,048,
(T-7) Dickerson U.S. Pat. No. 4,414,304,
(T-8) Mignot U.S. Pat. No. 4,386,156,
(T-9) Jones et al U.S. Pat. No. 4,478,929,
(T-10) Evans et al U.S. Pat. No. 4,504,570,
(T-11) Maskasky U.S. Pat. No. 4,400,463,
(T-12) Wey et al U.S. Pat. No. 4,414,306,
(T-13) Maskasky U.S. Pat. No. 4,435,501,
(T-14) Abbott et al U.S. Pat. No. 4,425,426,
(T-15) *Research Disclosure,* Vol. 232, Aug. 1983, Item 23212, and
(T-16) *Research Disclosure,* Vol. 225, Jan. 1983, Item 22534.

*Research Disclosure* is published by Kenneth Mason Publications, Ltd., Emsworth, Hampshire P010 7DD, England.

While initial investigations of tabular grain emulsions focused on serving predominantly higher speed photographic applications, more recently attention has been focused on relatively slower speed emulsions.

Daubendiek et al U.S. Ser. Nos. 790,692 and 790,693, both filed Oct. 23, 1985, refiled Aug. 1, 1986, as U.S. Ser. Nos. 891,803 and 891,804, respectively, all commonly assigned, disclose the utility of small, thin tabular grain emulsions in color photograpay. Specifically, the utility is disclosed in blue and minus blue recording layers of color photographic elements of emulsions having tabular grain mean diameters in the range of from 0.2 to 0.55 μm, wherein the grains have average aspect ratios greater than 8:1 and account for greater than 50 percent of the total grain projected areas.

A unifying theme running through these various tabular grain emulsion disclosures is the importance of having the tabular grains account for a high proportion of the total grain projected area, where the term "projected area" is used in the same sense as the terms "projection area" and "projective area" commonly employed in the art; see, for example, James and Higgins, *Fundamentals of Photographic Theory*, Morgan and Morgan, New York, p. 15. These disclosures also emphasize the importance of increasing average aspect ratios, where aspect ratio is defined as the ratio of the diameter of a tabular grain to its thickness. The diameter of a tabular grain is the diameter of a circle whose area is equal to the projected area of the tabular grain. It is generally recognized and accepted that to the extent (i) the average aspect ratio of a tabular grains and (ii) the percentage of the total grain projected area accounted for by tabular grains, can be increased, the photographic properties of the tabular grain emulsions can be improved.

All photographically useful silver halides form grains—i.e., microcrystals—of a cubic crystal lattice structure. The silver halide grains are bounded by cubic or {100} crystallographic planes, octahedral or {111} crystallographic planes, and/or rhombic dodecahedral or {110} crystallographic planes, the latter occurring only rarely. {100} (occasionally also referred to as {200}), {111}, and {110} are Miller index assignments of the grain crystal faces. Regular grains bounded entirely by {100} crystal faces form regular cubes, regular grains bounded by {111} crystal faces form regular octahedra, and regular grains bounded by {110} crystal faces form regular rhombododecahedra.

It has been recently observed that there are four additional families of crystallographic planes that can bound cubic crystal lattice silver halide grains:

(1) Maskasky U.S. Ser. No. 771,861, titled SILVER HALIDE PHOTOGRAPHIC EMULSIONS WITH NOVEL GRAIN FACES (1), discloses emulsions containing silver halide grains bounded by hexoctahedral crystallographic planes. Hexoctahedral crystallographic planes satisfy the Miller index assignment {hkl}, wherein h, k, and l are integers greater than zero, h is greater than k, and k is greater than l. Most commonly h is 5 or less.

(2) Maskasky U.S. Ser. No. 772,228, titled SILVER HALIDE PHOTOGRAPHIC EMULSIONS WITH NOVEL GRAIN FACES (2), discloses emulsions containing silver halide grains bounded by tetrahexahedral crystallographic planes. Tetrahexahedral crystallographic planes satisfy the Miller index assignment {hh0}, wherein 0 is zero, h and k are integers greater than 0 and different from each other. Most commonly h and k are no greater than 5.

(3) Maskasky U.S. Ser. No. 772,229, titled SILVER HALIDE PHOTOGRAPHIC EMULSIONS WITH NOVEL GRAIN FACES (3), discloses emulsions containing silver halide grains bounded by trisoctahedral crystallographic planes. Trisoctahedral crystallographic planes satisfy the Miller index assignment {hhl}, wherein h and l are integers greater than zero and h is greater than l. Most commonly h is no greater than 5.

(4) Maskasky U.S. Ser. No. 772,230, titled SILVER HALIDE PHOTOGRAPHIC EMULSIONS WITH NOVEL GRAIN FACES (4), discloses emulsions containing silver halide grains bounded by icositetrahedral crystallographic planes. Icositetrahedral crystallograpaic planes satisfy the Miller index assignment {hll}, wherein h and l are integers greater than zero and h is greater than l. Most commonly h is no greater than 5.

These patent applications were all filed Sept. 3, 1985, and refiled as U.S. Ser. Nos. 881,768, 881,769, 882,112, and 882,113, on July 3, 1986, and are all commonly assigned. The novel crystallographic faces were made possible by finding grain growth modifiers capable of reducing the rate of growth of the crystal face desired, since it is the slowest growing crystal faces that bound the grains and give them their surfaces.

(5) Maskasky U.S. Ser. No. 772,271, filed Sept. 3, 1985, commonly assigned, titled SILVER HALIDE PHOTOGRAPHIC EMULSIONS WITH NOVEL GRAIN FACES (5) discloses tabular grain emulsions having opposed major octahedral or 55 111} faces which are ruffled by the deposition of silver halide thereon. By the use of grain growth modifiers ruffling deposits capable of forming any of the remaining six families of crystallographic planes possible with cubic crystal lattice silver halide grains can be formed.

SUMMARY OF THE INVENTION

In one aspect this invention is directed to a photographic emulsion comprised of tabular silver halide grains having opposed major faces. The emulsions are characterized in that tabular grains are present having ledges of relatively reduced thickness extending laterally beyond at least one of said major faces.

The advantages of the present invention are that the known desirable properties of tabular grain emulsions for photographic applications can be further enhanced. The ledge extensions of the tabular grains increase the projected area of the grains. In addition, since the thickness of the ledges is less than that of the tabular grains measured between the opposed major faces, it is apparent that the effective aspect ratio of the tabular grains is increased. Stated more succinctly, the present invention can be employed to enhance the tabularity of photographic silver halide emulsions.

BRIEF DESCRIPTION OF THE DRAWINGS

The invention and its advantages can be better appreciated by reference to the following detailed description considered in conjunction with the drawings, in which

FIGS. 3 and 4 are plan views of the tabular grains of FIGS. 1 and 2, respectively, converted to tabular grains satisfying the requirements of this invention;

All of the grains shown in the figures are normally too small to be observed by the unaided eye and thus are greatly enlarged. Further, the relative thickness of the grains, where shown, has been exaggerated for ease of illustration.

DESCRIPTION OF PREFERRED EMBODIMENTS

In conventional photographic tabular grain silver halide emulsions the majority of tabular grains present appear in plan view to have opposed major faces which correspond in shape to a hexagon or an equilateral triangle. While the grains have opposed parallel major crystal faces, the faces are superimposed so that only one major face is visible.

Figure 1:
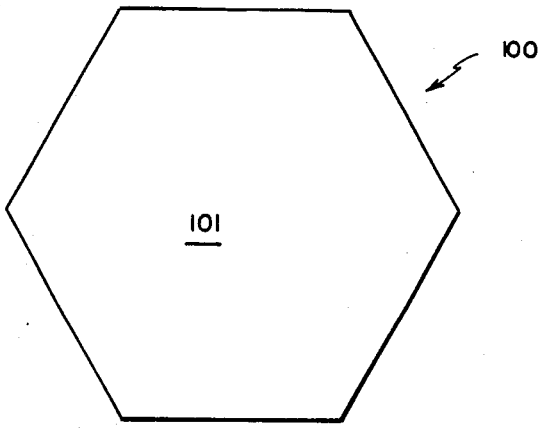
FIGS. 1 and 2 are plan views of typical conventional tabular grains.
Figure 2:
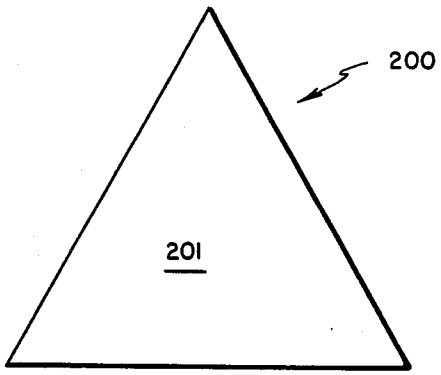

FIG. 1 shows a conventional tabular grain 100 presenting a major face 101 of a hexagonal shape. FIG. 2 shows a conventional tabular grain 200 presenting a major face 201 of a triangular shape. FIGS. 3 and 4 illustrate tabular grains from emulsions of this invention, which are formed from the conventional tabular grains 100 and 200, respectively.

It is readily apparent that the tabular grain 300 in FIG. 3 differs from the grain 100 of FIG. 1 in that it presents a larger projected area and exhibits a distinctive shape. The grain 300 is bounded by twelve edges 301*a*, 301*b*, 301*c*, 301*d*, 301*e*, 301*f*, 301*g*, 301*h*, 301*i*, 301*j*, 301*k*, and 301*l*, which appear distinctly linear. Completing the periphery of the grain as viewed in plan are six edges 307*a*, 307*b*, 307*c*, 307*d*, 307*e*, and 307*f*, which sometimes appear linear, but frequently appear uneven, as shown. In some hexagonal tabular grains according to this invention the 307 series edges are not present. Instead of having a 307 series edge separating two 301 series edges the 301 series edges intersect forming a coign at their intersection.

There is also a difference when viewed under a reflected light microscope that FIGS. 1 and 3 do not capture, since they do not show the hue of the grains. It is known that conventional tabular grains by reason for the fractional μm spacings between their major faces as well as the parallel relationship of the major faces exhibit brilliant colors of uniform hue. The tabular grain 100 can be of any visible hue, depending upon its exact thickness. The relationship between tabular grain thickness and the wavelength of reflected light is discussed in *Research Disclosure*, Vol. 253, May 1985, Item 25330. When the tabular grain 100 is of uniform composition throughout, as is usually the case, it exhibits one visible hue. The hue is often a highly saturated primary color.

Viewed under a microscope the grain 300 similarly exhibits a single hue within the hexagonal area bounded by edges 303*a*, 303*b*, and 303*c* and alternating edges 305*a*, 305*b*, and 305*c*. However, in the areas lying laterally beyond the hexagonal area, hereinafter referred to as shelves or ledges, a distinctly different hue is observed. In some instances the triad of ledges 309*a*, 309*b*, and 309*c*, lying adjacent the hexagonal area edges 303*a*, 303*b*, and 303*c*, respectively, are of a different hue than the triad of ledges 311*a*, 311*b*, and 311*c* lying adjacent the hexagonal area edges 305*a*, 305*b*, and 305*c*, respectively. However, the ledges within each triad are of identical hue. This indicates that the ledges within each triad are all of the same uniform thickness and that this thickness is different from the thickness of the hexagonal area of the grain.

Upon direct viewing or in color photomicrographs both triads of ledges are visible because of the hue differentiation of the hexagonal area of the tabular grain. In electron photomicrographs, the hexagonal area edges 303*a*, 303*b*, and 303*c* are clearly visible, indicating that these edges on the viewed side of the tabular grain. On the other hand, the hexagonal area edges 305*a*, 305*b*, and 305*c* are not visible, indicating that they are edges on the remote side of the tabular grain.

From these observations it is apparent that edges 303*a*, 301*c*, 307*b*, 301*d*, 303*b*, 301*g*, 307*d*, 301*h*, 303*c*, 301*k*, 307*f*, and 301*l* are the boundaries of the upper major face of the tabular grain 300 while the edges 301*a*, 307*a*, 301*b*, 305*a*, 301*e*, 307*c*, 301*f*, 305*b*, 301*i*, 307*e*, 301*j*, and 305*c* define the boundaries of the lower major face of the tabular grain 300. The two major faces are identical, but differ by an angle of 60° in their edge orientations. Each major face is laterally extended by one triad of ledges. Electron microscopic examination of grains tipped sufficiently to permit edge viewing confirm the presence of ledges of relatively uniform thickness and of less thickness than the spacing between the grain major faces.

It is similarly apparent that the tabular grain 400 in FIG. 4 differs from the grain 200 of FIG. 2 in that it presents a larger projected area and exhibits a distinctive shape. The grain exhibits edges 401*a*, 401*b*, and 401*c* that define a triangular area 403 corresponding to the major face 201. This area is of one uniform hue, indicating that it is of uniform thickness. Lying along each of the triangle defining edges are ledges 405*a*, 405*b*, and 405*c*. These ledges are all of the same hue, which differs from that of the triangular area, indicating that the ledges are of uniform thickness and of a thickness different from that of the triangular area. Since the edges 401*a*, 401*b*, and 401*c* are all visible and since no grains of this shape have been observed in which these edges are not visible, it is apparent that the ledges do not form extensions of either of the two triangular major faces of these grains.

In viewing tabular grains with triangular major faces and ledges in emulsions according to this invention, it is noted that at an early stage of formation the ledges can appear as discontinuous protrusions along the equilateral triangle edges. with further growth the ledges become continuous along an edge. Like the linear 301 series edges of the grain 300 linear edges 409*a*, 409*b*, 409*c*, 409*d*, 409*e* and 409*f* are noted to diverge from the coigns 407*a*, 407*b* and 407*c* of the triangular area 403. The edges 411*a*, 411*b*, and 411*c* initially appear uneven, but with continued growth often appear linear and parallel to the triangle edges 401*a*, 401*b*, and 401*c*, respectively. It is possible to grow the 411 series edges out of existence. In other words the two 409 series edges forming a ledge can intersect forming a coign at their intersection. This has been observed for relatively smaller projected area grains, but should be possible with continued ledge growth for larger projected area grains as well.

The ledges of the tabular grain emulsions of this invention preferably account for at least 5 percent of the total projected area of the tabular grains having ledges. While it is believed that ledge projected areas can account for 50 percent of the total projected area of a tabular grain having ledges, tabular grains having ledge projected areas in the range of from about 5 to 20 percent based on the total projected area of tabular grains having ledges are most conveniently prepared.

Emulsions satisfying the requirements of this invention can be prepared by growing ledges on the tabular grains of any conventional photographic silver halide emulsion containing hexagonal or triangular projected area tabular grains. For example, emulsions according to this invention can be prepared by growing shelves or ledges on any of the intermediate and high aspect ratio tabular grain emulsions disclosed in references T-1 through T-17, cited above, except T-8, which discloses only square and rectangular projected area tabular grains.

At least 35 percent of the total grain projected area of emulsions according to the invention are accounted for by tabular grains having ledges. Usually, instead of 35 percent, tabular grains having ledges account for at least 50 percent and preferably at least 70 percent of the total grain projected area.

In general the tabular grain emulsions of this invention satisfying the projected area requirements indicated above are those in which the tabular grains having ledges counted in satisfying the projected area percentages have a thickness between their major faces of 0.5 μm or less, preferably 0.3 μm or less, and optimally 0.2 μm or less. Tabular grains of such thickness typically have an average aspect ratio of greater than 5:1, preferably greater than 8:1, and optimally at least 12:1. Conventional tabular grain emulsions are known to have aspect ratios ranging up to 100:1 and, in some instances, up to 200:1. Optimum average aspect ratios are typically in the range of from 12:1 to about 75:1 for silver bromide and bromoiodide emulsions. The addition of ledges should permit these average aspect ratios to be more readily satisfied or even increased.

In determining the aspect ratio of tabular grains having ledges the projected area contributed by the ledges is included in calculating the grain diameter, but the tabular grain thickness remains the distance between the major faces of the grain and does not take into account the thinning of the tabular grains attributable to the presence of the ledges. The reason for this basis of definition is that grain thickness is most readily determined by grain shadow lengths, which do not lend themselves to ledge thickness determinations. It therefore must be kept in mind that a tabular grain having ledges according to this invention having a calculated aspect ratio of 12:1, for example, actually has a somewhat higher aspect ratio than a conventional tabular grain lacking ledge extensions and also having a calculated aspect ratio of 12:1.

The preferred photographic emulsions according to this invention are those in which tabular silver bromide or silver bromoiodide grains with ledges and having a thickness of 0.3 μm or less (optimally 0.2 μm or less) have an average aspect ratio of greater than 8:1 (optimally at least 12:1) and account for greater than 50 percent (optimally greater than 70 percent) of the total grain projected area. In these emulsions the ledges account for at least 5 percent (optimally 5 to 20 percent) of the projected area of the tabular grains having ledges.

The composition of the tabular grains having ledges can correspond to that of the tabular grains of known photographic silver halide emulsions. Tabular grains having ledges consisting essentially of silver bromide are readily formed. Silver bromoiodide tabular grain emulsions according to this invention can be formed readily also, particularly where the iodide concentration is maintained at about 6 mole percent or less, based on silver.

The ledges of the tabular grains are grown onto host tabular grains. The ledges can be of the same composition as the host tabular grains. The host tabular grains as well as the ledges grown on them can be of either uniform composition or nonuniform composition. For example, (T-6) Solberg et al, cited above, discloses higher iodide peripherally than in a central grain region while (T-12) Wey et al, cited above, discloses silver chlorobromide in an annular tabular grain region. Where the host tabular grains are themselves of nonuniform composition, it is generally most convenient to deposit ledges at least initially of a composition similar to that of the peripheral edges initially presented by the host tabular grains. It is specifically contemplated to vary the composition of the ledges as they are being formed. For example, although the techniques disclosed by (T-13) Maskasky, cited above, have not been observed to create ledges, these techniques can be used to extend or decorate epitaxially the ledges following initial formation by the techniques of this invention. The teachings of (T-13) Maskasky for controlled site epitaxial depositions are entirely compatible with tabular grains having ledges according to this invention.

Processes by which ledges can be grown on host tabular grains are illustrated in the examples below. In general ledge growth can be undertaken under conventional silver halide precipitation conditions, including grain ripening conditions, in the presence of a suitable growth modifier. Azaindene, particularly tetraazaindene grain growth modifiers, such as 4-hydroxy-6-methyl-1,3,3*a*,7-tetraazaindenes, have been found to be effective. Fortunately, these azaindenes are known to be useful photographic antifoggants and stabilizers and, in certain instances, sensitizers. Therefore, the azaindene grain growth modifiers can, if desired, be left in the emulsions after ledge formation and serve further useful purposes in subsequent photographic uses of the emulsions.

The features of the emulsions so far discussed can be readily verified by observation and in no way depend upon any particular theoretical explanation. It is therefore neither intended nor necessary to depend on any particular theory to account for or describe the emulsions of this invention. Nevertheless, the observations of this invention are compatible with accepted theories as to the structure of photographically useful tabular silver halide grains and suggest refinements and extensions of these theories, which have been at least partially corroborated by further original investigations. Therefore, the following explanation is offered to provide not only a better insight into the probable structure of the tabular grains, but also a better insight into why and how they are formed. These insights should be useful to those skilled in the art in later investigations of these and derivative tabular grain emulsions.

Figure 5:
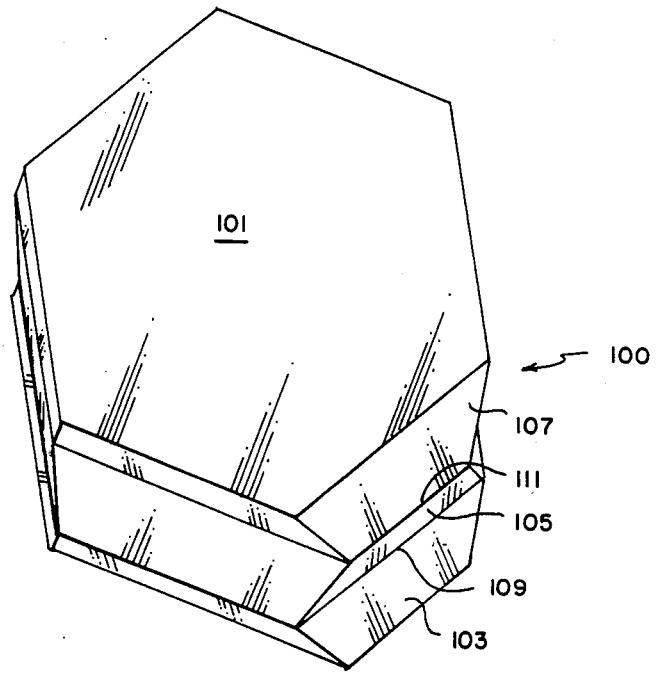
FIGS. 5 and 6 are isometric views of conventional tabular grains.

FIG. 5 presents an isometric view of the tabular grain 100 shown in FIG. 1, but with the thickness of the grain exaggerated for ease of illustration. Prior to this invention tabular silver bromide grains have been grown to sizes larger than those useful in photography and reported to have the appearance shown in FIG. 5. The grain 100 as shown consists of three superimposed strata 103, 105, and 107. The stratum 107 lies adjacent the upper major face 101 while the lower stratum 103 lies adjacent the parallel, opposed major face, not visible. A crystallographic twin plane 109 separates the strata 103 and 105 while a second crystallographic twin plane 111 separates the strata 105 and 107. Three edges of the strata 103 and 105 each form a reentrant angle of intersection of 141° while three alternate edges of these strata each form a nonreentrant angle of intersection of 219°. The strata 105 and 107 form similar angles of intersection, but oriented so that each reentrant angle of intersection of strata 105 and 107 lies above a nonreentrant angle of intersection of the strata 103 and 105 and vice versa. Thus, joining corresponding hexagonal major face edges there are strata edges forming one reentrant angle of intersection and one nonreentrant angle of intersection. It is generally accepted that the high aspect ratios of tabular grains is accounted for by the silver halide edge deposition preference created by the reentrant angles of intersection as compared to deposition on the major faces of the grains.

In original observations of conventional silver bromide tabular grain emulsions it has been confirmed that most tabular grains present hexagonal projected areas and that most of these grains contain two twin planes. As is well recognized in the art a significant proportion of tabular grains present equilaterally triangular projected areas. On closer inspection many of the triangular projected areas are in fact hexagonal, but with three of the alternate edges of the hexagon being relatively restricted. For purpose of this discussion a tabular grain having a triangular projected area is defined as any grain having three major face edges more than an order of magnitude (10×) longer than any other edge of the major face. Using this definition it was noted that the common tabular grains encountered in sample conventional tabular grain silver bromide emulsions were as follows:

Grain Category I—Hexagonal projected area tabular grains containing an even number of twin planes (typically >80 percent of the grains);

Grain Category II—Triangular projected area tabular grains containing an odd number of twin planes (typically in the order of about 10 percent of the grains);

Grain Category III—Triangular projected area tabular grains containing an even number of twin planes (typically in the order of about 1 to 2 percent of the grains); and Grain Category IV—Hexagonal projected area tabular grains containing an odd number of twin planes (typically in the order of about 1 percent of the grains).

Miscellaneous—A variety of grain shapes, including most notably tabular grains of trapezoidal and double trapezoidal projected areas. (For a discussion of trapezoidal projected area tabular grains, attention is directed to Maskasky U.S. Ser. No. 811,132, filed Dec. 19, 1985, titled A PROCESS FOR PRECIPITATING A TABULAR GRAIN EMULSION IN THE PRESENCE OF A GELATINO--PEPTIZER AND AN EMULSION PRODUCED THEREBY, commonly assigned.) While the proportions of the various grains can vary appreciably from one emulsion to the next, the relative order of occurrence is considered less likely to vary.

Figure 6:
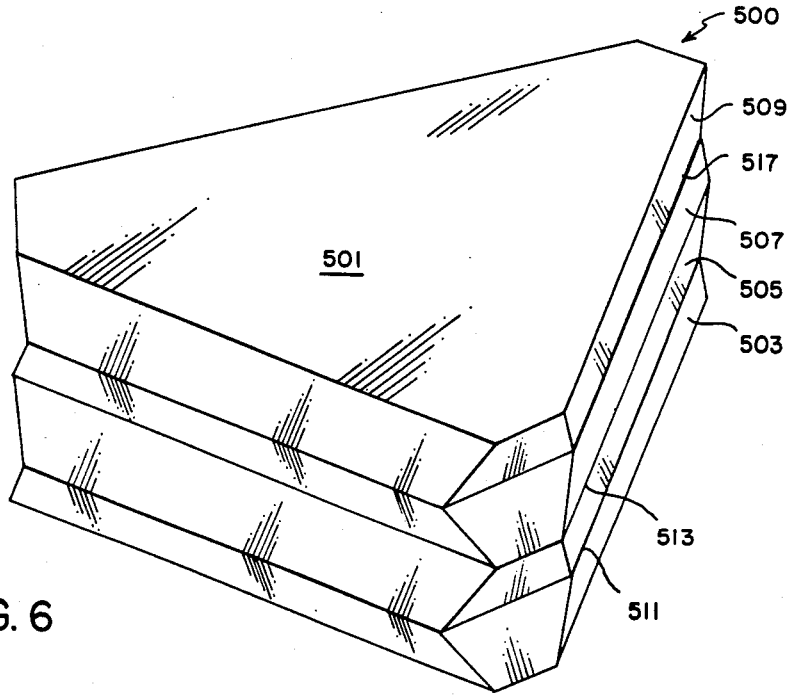

When a tabular grain is being grown having two parallel twin planes, which is believed to be the minimum number of twin planes necessary in most instances to achieve high aspect ratios (greater than 8:1), an additional twin plane sometimes forms. The third twin plane predisposes the tabular grain to form a triangular rather than a hexagonal projected area. This can be appreciated by reference to FIG. 6, wherein a tabular grain 500 is shown having a hexagonal major face 501 and an opposed parallel hexagonal major face, which is not visible. The tabular grain consists of four superimposed strata 503, 505, 507, and 509. Separating adjacent strata are twin planes 511, 513, and 517. The edges of the strata form reentrant and nonreentrant angles of intersection similarly as the tabular grain 100, but with an important difference. It is to be noted that as shown the strata edges joining the shorter hexagonal major face edges form two reentrant angles of intersection, whereas the strata edges joining the longer hexagonal major face edges form only one reentrant angle of intersection. Based on previously accepted theories of tabular grain growth, the two to one ratio of reentrant angles of intersection should cause the strata edges joining the shorter major face edges to grow much more rapidly than the strata edges joining the longer major face edges. The result is that the shorter major face edges become progressively shorter as grain growth continues, and the hexagonal projected area of the tabular grain becomes a triangular projected area in accordance the definition provided above.

The foregoing mechanism of triangular projected area tabular grain formation is supported by the relative frequencies of the various grain categories listed above. Specifically, it is believed that a few of the grains in Grain Category I experience an additional twinning event that moves them immediately into Grain Category IV. There are few grains in Grain Category IV, since these grains are in rapid growth transition to Grain Category II. Grain Category III may result from the strata forming the major faces exhibiting pronounced differences in their thicknesses, resulting in an asymmetry in the reentrant angles of intersection of alternate edges.

The observation and categorization of tabular grains according to even or odd numbers of twin planes is an original observation, whereas the attribution of rapid edge growth in tabular grains to reentrant angles of strata edge intersections is in accordance with accepted theories. However, from further observations, discussed below, it is now believed that a more important determinant to rapid edge growth of tabular silver halide grains than the reentrant angle of interaction of strata edges is the angle which a stratum edge makes with the major face of the tabular grain. A stratum edge can by intersecting a major face at an angle of 70.5° form an acute lip or by intersecting a major face at an angle of 109.5° form an obtuse lip.

It is believed that it is the difference in surface crystallographic planes present at the apex of acute lips and obtuse lips that make ledge growth on tabular grains according to this invention possible. This can best be appreciated by reference to FIGS. 7A and 7B, which are enlarged sections of the tabular grain 300 in FIG. 3. As shown in these figures the tabular grain 300 has a first major face 701 and a second major face 703. The major faces, like those of most conventional tabular grains, lie in parallel octahedral (i.e., {111}) crystallographic planes. The tabular grain consists of strata 705, 707, and 709 lying between the major faces. Strata 705 and 707 are separated by a twin plane 711 while strata 707 and 709 are separated by a twin plane 713.

Figure 7B:
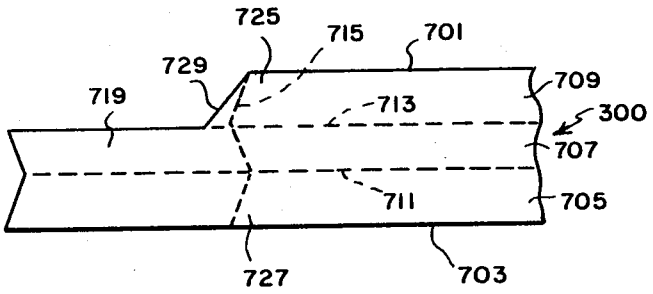
FIGS. 7A and 7B are enlarged sectional details of the grain of FIG. 3 taken along section lines 7A—7A and 7B—7B, respectively.
Figure 7A:
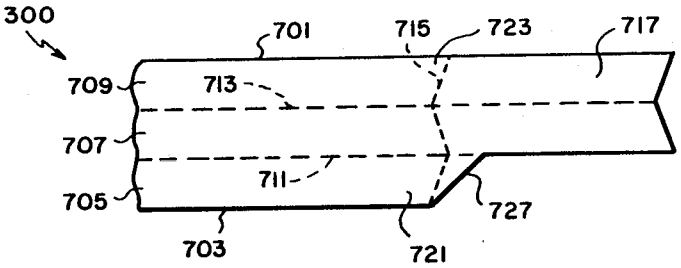

It is generally believed that all of the strata edge surfaces in conventional tabular grains as well as the major faces lie in {111} crystallographic planes. The strata edges of the host tabular grain onto which the ledges are grown are indicated by dashed lines 715 in FIGS. 7A and 7B. Extending laterally beyond the host tabular grain edge 715 in FIG. 7A is an upper ledge 717 formed by strata 707 and 709. The upper surface of the upper ledge forms an extension of the upper major face 701; however, the lower surface of the upper ledge does not extend below the twin plan 711. The lower ledge 719 in FIG. 7B is of similar structure, its lower surface forming an extension of the major face 703. The lower ledge does not extend above the twin plane 713.

It is believed that ledge growth in the form shown in FIGS. 7A and 7B is made possible by the host tabular grain edge 715 forming in FIG. 7A an obtuse lip 721 with the major face 703 and an acute lip 723 with the major face 701 and in FIG. 7B an obtuse lip 725 with the major face 701 and an acute lip with the major face 727. If host tabular grain {111} strata edges represented by 715 intersected the {111} major faces of the host tabular grains without any other crystal face being present at the grain surface, then it would be immaterial whether obtuse or acute lips were formed. However, it is well known that silver halide at the corners of grains is more readily solubilized than silver halide on flat grain faces, and it is further a common observation that silver halide grains exhibit rounding at the grain corners. It is believed that apices of the acute lips are rounded to reveal cubic or {100} crystal faces as well as icositetra-hedral or {hll} crystal faces. At the same time the apices of the obtuse lips are rounded to reveal rhombic dodecahedral or {110} crystal faces as well as trisoctahedral or {hhl} crystal faces. In the foregoing Miller index assignments h and l are both integers greater than zero and h is greater than l. Although h is not theoretically limited, it is typically 5 or less.

It has been discovered that by employing a growth modifier capable of slowing the rate of silver halide deposition on trisoctahedral or {hhl} crystal faces it is possible to arrest the lateral growth of the tabular grain strata at their obtuse lips. It is believed that the obtuse lips grow only slightly to form trisoctahedral or {hhl} crystal faces, shown as faces 727 and 729 in FIGS. 7A and 7B, respectively. For example, the angle which the host tabular grain initially forms at its obtuse lips is 109.5°. When that angle is increased slightly to 136.7°, a {551} trisoctahedral crystal face is presented. By employing a grain growth modifier that adsorbs selectively to a {551} crystal face, the further deposition of silver halide on this crystal face, once formed, is arrested, and the {551} crystal face remains as a part of the final grain topography. Note that it is important that a growth modifier be employed which adsorbs selectively to trisoctahedral crystal faces as opposed to icositetrahedral or cubic crystal faces.

Figure 8:
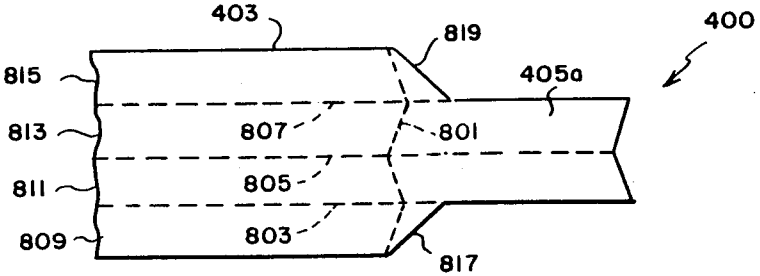
FIG. 8 is an enlarged sectional detail of the grain of FIG. 4.

Turning to FIG. 8, the sectional detail shown reveals ledge 405*a* to extend laterally beyond the major face 403 of the grain. The boundary of the host grain onto which the ledges were grown is shown by dashed line 801. The important difference between the hexagonal projected area tabular grains of FIGS. 3, 5, 7A, and 7B on the one hand and the tabular grains of FIGS. 4 and 8 on the other hand, is that the latter grains contain three twin planes 803, 805, and 807 separating four strata 809, 811, 813, and 815 rather than two parallel twin planes. This results in the triangular projected area tabular grains presenting obtuse lips at each of the edges of strata adjacent their major faces. Thia allows an adsorbed growth modifier to arrest the lateral growth of strata 809 and 815 adjacent the major faces. These two strata grow laterally only a negligible extent before forming trioctahedral crystal faces, indicated at 817 and 819. The interior strata 811 and 813 remain free to grow laterally and do so to form the ledge 405*a*.

In the illustrative grains shown the strata forming the grains are all of uniform thickness. In this circumstance the ledges formed by the hexagonal projected area grains are two thirds the thickness of the host tabular grain while the ledges formed by the triangular projected area grains are only one half the thickness of the host tabular grain. In actuality the intervals between twinning events can vary so that strata of differing thicknesses can be formed within a single grain. It is believed, but not proven, that tabular grains having regular hexagon projected areas have at least symmetrical, if not identical strata thicknesses, while hexagonal projected area tabular grains with alternate triads of longer and shorter edges may exhibit dissimilar strata thicknesses.

Apart from the features described above, the tabular grain emulsions of this invention include features corresponding to those known in conventional tabular grain emulsions. The teachings of references T-1 through T-7 and T-9 through T-17 are here incorporated by reference to show conventional features, such as dispersing media (including peptizers and binders), vehicle hardening, chemical sensitization, spectral sensitization, emulsion blending, and varied addenda, such as antifoggants and stabilizers, and coating aids. *Research Disclosure*, Vol. 176, Dec. 1978, Item 17643, is also incorporated by reference to show conventional emulsion features. The emulsions can be employed in photographic elements, exposed, and processed in any conventional matter, also illustrated by these references.

In addition to conventional dispersing media it is contemplated to employ gelatino-peptizers containing less than 30 micromoles of methionine per gram. Such gelatino-peptizers can be prepared by treating a conventional gelatino--peptizer with a strong oxidizing agent, such as hydrogen peroxide. Tabular grain emulsions prepared in the presence of such peptizers are the subject of Maskasky U.S. Ser. No. 811,132 and 811,133, both filed Dec. 19, 1985, commonly assigned. These emulsions are particularly contemplated as host tabular grain emulsions for preparing emulsions according to this invention.

It is also specifically contemplated to employ as host tabular grain emulsions for preparing emulsions according to this invention small, thin tabular grain emulsions, as disclosed by Daubendiek et al U.S. Ser. Nos. 790,692 and 790,693, both filed Oct. 23, 1985, commonly assigned. The small, thin tabular grain emulsions are those having tabular grain mean diameters in the range of from 0.2 to 0.55 μm, wherein the grains have average aspect ratios greater than 8:1 and account for greater than 50 percent of the total grain projected areas. It is to be noted that a 0.2 μm diameter grain having an aspect ratio of 10:1 has a thickness of only 0.02 μm. By forming peripheral ledges the average thickness of the grain can be further reduced. Since a procedure for preparing small, thin tabular grains has not yet been published, it is included to complete this disclosure in Appendix A, below.

EXAMPLES

This invention can be better appreciated by reference to the following specific examples:

EXAMPLE 1

A reaction vessel equipped with a stirrer was charged with 7.5 mmole of a freshly prepared (less than 3 hrs. old) 0.02 μm AgBr emulsion containing 167 g/Ag mole deionized bone gelatin and made up to 32.5 g with water. To the emulsion at 40° C. was added with stirring, 0.090 mmole (6 mmole/Ag mole host) of the growth modifier 5-bromo-4-hydroxy-6-methyl-1,3,3*a*,7-tetraazaindene (GM-I) dissolved in water containing a small amount of triethylamine. To this mixture was added 15 mmole of a host tabular grain silver bromide emulsion (0.0033 mole % AgI), of mean grain size 10.5 μm, average tabular grain thickness 0.23 μm, and average tabular grain aspect ratio 46:1. The tabular grains accounted for greater than 50 percent of the total grain projected area. The tabular grain emulsion contained about 17 g/Ag mole of bone gelatin and water to a total weight of 13.2 g. The pH was adjusted to 6.0 at 40° C. (all pH adjustments were with NaOH or $HNO_3$, as required), and the pBr to 1.54 at 40° C. with NaBr solution. The mixture was heated for 1 hr at 60° C.

Figure 9:
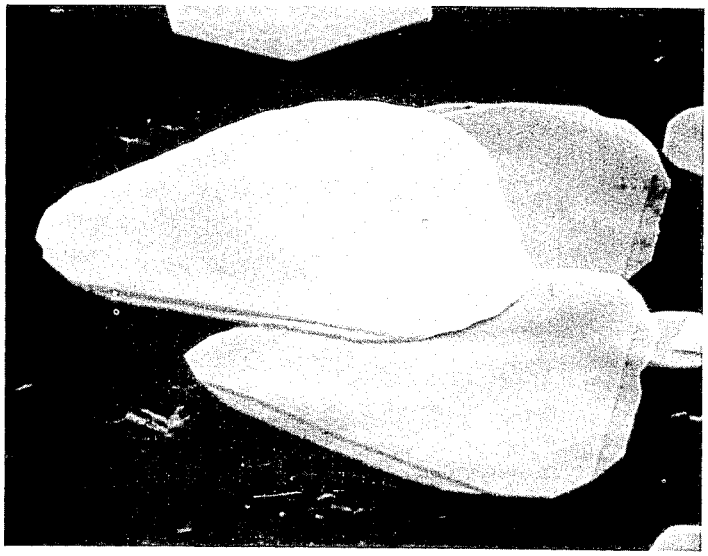
FIGS. 9 through 12 are electron micrographs of emulsions according to this invention.

FIG. 9 is a scanning electron micrograph of the resulting modified tabular grains, made with a 60° angle of tilt. Greater than 50 percent of the total grain projected area was accounted for by tabular grains having ledges and the ledges accounted for greater than 5 percent of the the projected area of the tabular grains having ledges.

EXAMPLE 2

The host for Example 2 was a tabular grain pure AgBr emulsion, of mean grain size 4.8 μm, mean tabular grain thickness 0.15 μm, and average tabular grain aspect ratio 32:1. The tabular grains accounted for more than 50 percent of the total grain projected area. A fine grain emulsion provided for the Ostwald ripening procedure was a 0.02 μm pure AgBr freshly made preparation. The procedure employed was like that for Example 1, except that after the first ½ hour of ripening an additional 32.5 g (7.5 mmole) of the fine grain emulsion and an additional 0.090 mmole of GM-I were added. After the second addition the pH was adjusted to 5.83 at 60° C., and the pBr to 1.50 at 60° C. The ripening was then continued at 60° C. for the second ½ hour.

Figure 10:
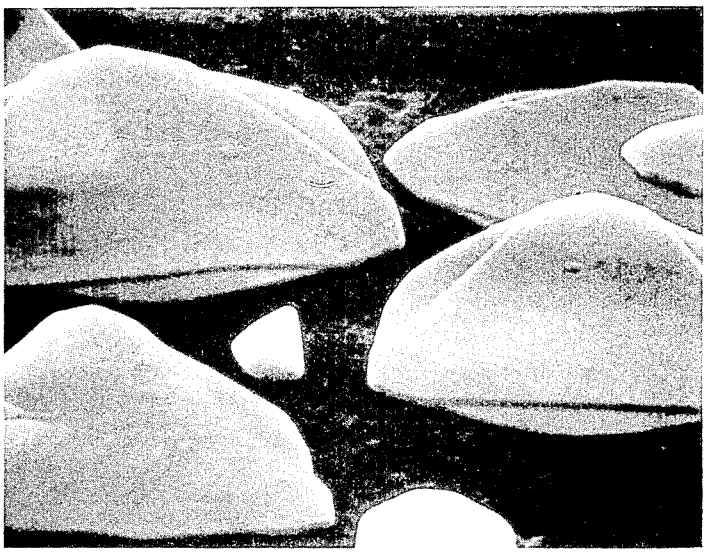

FIG. 10 is a scanning electron micrograph of the resulting modified tabular grains, made with a 60° angle of tilt. Greater than 50 percent of the total grain projected area was accounted for by tabular grains having ledges and the ledges accounted for greater than 5 percent of the the projected area of the tabular grains having ledges.

EXAMPLE 3

The host tabular grain emulsion for Example 3 was a tabular AgBrI (1 mole % I) emulsion of mean grain size 8.6 μm, tabular grain thickness 0.140 μm, and average tabular grain aspect ratio 61:1. Tabular grains accounted for greater than 50 percent of the total grain projected area. The fine grain emulsion was a fresh remake of the emulsion used in Example 1. The procedure was otherwise as described in Example 1.

Figure 11:
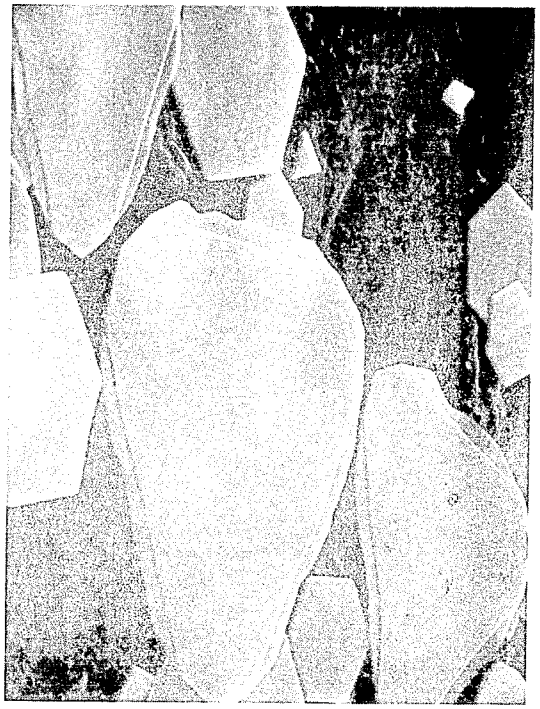

FIG. 11 is a scanning electron micrograph of the resulting modified tabular grains, made with a 60° angle of tilt. Greater than 50 percent of the total grain projected area was accounted for by tabular grains having ledges and the ledges accounted for greater than 5 percent of the the projected area of the tabular grains having ledges.

EXAMPLE 4

The host for Example 4 was the same AgBrI (1 mole % I) emulsion as used in Example 3. The fine grain emulsion was a 0.02 μm mean grain size AgBrI (1 mole % I) fresh preparation. The procedure was as described in Example 1, except that Ostwald ripening was carried out for ½ hour.

Figure 12:
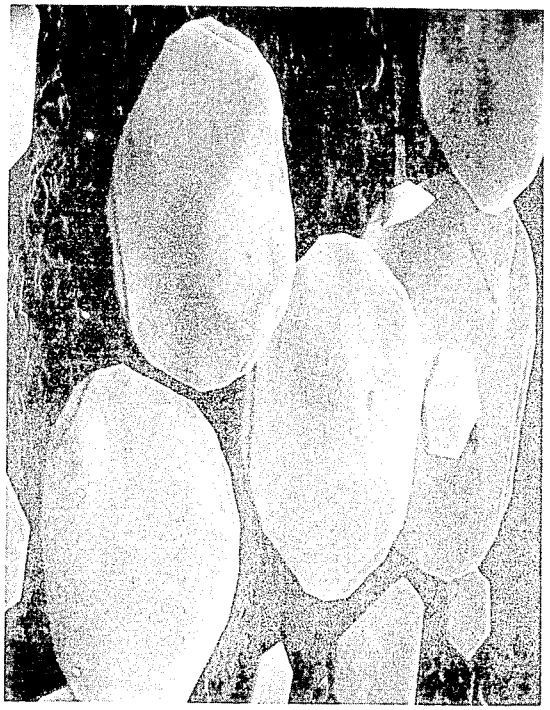

FIG. 12 is a scanning electron micrograph of the resulting modified tabular grains, made with a 60° angle of tilt. Greater than 50 percent of the total grain projected area was accounted for by tabular grains having ledges and the ledges accounted for greater than 5 percent of the the projected area of the tabular grains having ledges.

APPENDIX A

Preparation of Small Thin High Aspect Ratio Tabular Grain Host Emulsions

Emulsion A

To a reaction vessel equipped with efficient stirring was added 3.0L of a solution containing 7.5 g of bone gelatin. The solution also contained 0.7 mL of an antifoaming agent. The pH was adjusted to 1.94 at 35° C. with $H_2SO_4$ and the pAg to 9.53 by the addition of an aqueous potassium bromide solution. To the vessel was simultaneously added over a period of 12 s a 1.25M solution of $AgNO_3$ and a 1.25M solution of KBr+KI (94:6 mole ratio) at a constant rate, consuming 0.02 moles Ag. The temperature was raised to 60° C. (5°C./3 min) and 66 g of bone gelatin in 400 mL of water was added. The pH was adjusted to 6.00 at 60° C. with NaOH, and the pAg to 8.88° at 60° C. with KBr. Using a constant flow rate, the precipitation was continued with the addition of a 0.4M $AgNO_3$ solution over a period of 24.9 min. Concurrently at the same rate was added a 0.0121M suspension of an AgI emulsion (about 0.05 μm grain size; 40 g/Ag mole bone gelatin). A 0.4M KBr solution was also simultaneously added at the rate required to maintain the pAg at 8.88 during the precipitation. The $ABNO_3$ provided a total of 1.0 mole Ag in this step of the precipitation, with an additional 0.03 mole Ag being supplied by the AgI emulsion. The emulsion was coagulation washed by the procedure of Yutzy, et al., U.S. Pat. No. 2,614,929.

The equivalent circular diameter of the mean projected area of the grains as measured on scanning electron micrographs using a Zeiss MOP III Image Analyzer was found to be 0.5 μm. The average thickness, by measurement of the micrographs, was found to be 0.038 μm, resulting in an aspect ratio of approximately 13:1. Tabular grains accounted for greater than 70 percent of the total grain projected area.

Emulsion B

Emulsion B was prepared similarly as Emulsion A, the principal difference being that the bone gelatin employed was prepared for use in the following manner: To 500 g of 12 percent deionized bone gelatin was added 0.6 g of 30 percent $H_2O_2$ in 10 mL of distilled water. The mixture was stirred for 16 hours at 40° C., then cooled and stored for use.

To a reaction vessel equipped with efficient stirring was added 3.0 L of a solution containing 7.5 g of bone gelatin. The solution also contained 0.7 mL of an antifoaming agent. The pH was adjuated to 1.96 at 35° C. with $H_2SO_4$ and the pAg to 9.53 by addition of an aqueous solution of potassium bromide. To the vessel was simultaneously added over a period of 12 s a 1.25M solution of $AgNO_3$ and a 1.25M solution of KBr+KI (94:6 mole ratio) at a constant rate, consuming 0.02 moles Ag. The temperature was raised to 60° C. (5°C./3 min) and 70 g of bone gelatin in 500 mL of water was added. The pH was adjusted to 6.00 at 60° C. with NaOH, and the pAg to 8.88 at 60° C. with KBr. Using a constant flow rate, the precipitation was continued with the addition of a 1.2M $AgNO_3$ solution over a period of 17 min. Concurrently at the same rate was added a 0.04M suspension of an AgI emulsion (about 0.05 μm grain size; 40 g/Ag mole bone gelatin). A 1.2M KBr solution was also simultaneously added at the rate required to maintain the pAg at 8.88 during the precipitation. The $AgNO_3$ provided a total of 0.68 mole Ag in this step of the precipitation, with an additional 0.02 mole Ag being supplied by the AgI emulslon. The emulsion was coagulation washed by the procedure of Yutzy, et al., U.S. Pat. No. 2,614,929.

The equivalent circular diameter of the mean projected area of the grains as measured on scanning electron micrographs using a Zeiss MOP III Image Analyzer was found to be 0.43 μm. The average thickness, by measurement of the micrographs, was found to be 0.024 μm, resulting in an aspect ratio of approximately 17:1. Tabular grains accounted for greater than 70 percent of the total grain projected area.

The invention has been described in detail with particular reference to preferred embodiments thereof, but it will be understood that variations and modifications can be effected within the spirit and scope of the invention.

What is claimed is:

1. A photographic emulsion comprised of tabular silver halide grains having opposed major faces, characterized in that tabular grains are present having ledges of relatively reduced thickness extending laterally beyond at least one of said major faces.

2. An emulsion according to claim 1 further characterized in that said tabular grains include laterally offset ledges.

3. An emulsion according to claim 1 further characterized in that said tabular grains include ledges laterally spaced from both major faces.

4. An emulsion according to claim 1 further characterized in that said tabular grains include ledges each spaced from one major face and forming an extension of another major face.

5. An emulsion according to claim 4 further characterized in that next adjacent of said ledges form extensions of different major faces.

6. An emulsion according to claim 1 further characterized in that said tabular grains having ledges account for at least 50 percent of the total silver halide grain projected area of said emulsion.

7. An emulsion according to claim 6 further characterized in that said tabular grains having ledges have an average projected area of at least 70 percent of the grain projected area of said emulsion.

8. An emulsion according to claim 1 in which said ledges account for at least 5 percent of the total projected area of said tabular grains having ledges.

9. An emulsion according to claim 1 further characterized in that said tabular grains having ledges are comprised of silver bromide or silver bromoiodide.

10. An emulsion according to claim 1 further characterized in that said silver halide in said tabular grains having ledges consists essentially of silver bromide.

11. An emulsion according to claim 1 further characterized in that said silver halide in said tabular grains having ledges consists essentially of silver bromoiodide.

12. An emulsion according to claim 1 further characterized in that said tabular grains having ledges include at least three strata and each of said ledges form extensions of at least two of said strata.

13. An emulsion according to claim 12 further characterized in that at least a portion of said tabular grains having ledges include at least four strata.

14. An emulsion according to claim 12 further characterized in that said ledges form at least one acute angle edge lip.

15. An emulsion according to claim 1 further characterized in that said tabular grains having ledges are of a cubic crystal lattice structure and have opposed major faces lying in {111} crystallographic planes.

16. An emulsion according to claim 15 further characterized in that said emulsion contains a grain growth modifier capable of selectively restraining deposition of silver halide on grain faces lying in rhombic dodecahedral and trisoctahedral crystallographic planes while permitting deposition of silver halide on grain faces lying in cubic and icositetrahedral crystallographic planes.

17. An emulsion according to claim 16 further characterized in that said tabular grains having ledges consist essentially of silver bromide or silver bromoiodide containing up to 6 mole percent iodide, based on silver and contain an azaindene grain growth modifier.

18. An emulsion according to claim 17 further characterized in that said azaindene is a tetraazaindene.

19. A photographic emulsion comprised of a 5-bromo-4-hydroxy-6-methyl-1,3,3a,7-tetraazaindene and tabular silver bromide grains having opposed major faces lying in {111} crystallographic planes, characterized in that tabular grains accounting for at least 50 percent of the total grain projected area are present having ledges of a thickness less than the spacing between said opposed major faces and extending laterally beyond at least one of said major faces, said ledges accounting for at least 5 percent of the total projected area of said tabular grains having ledges.

20. A photographic emulsion comprised of a 5-bromo-4-hydroxy-6-methyl-1,3,3a,7-tetraazaindene and tabular silver bromoiodide grains containing up to 2 mole percent iodide, based on silver, and having opposed major faces lying in {111} crystallographic planes, characterized in that tabular grains accounting for at least 50 percent of the total grain projected area are present having ledges of a thickness less than the spacing between said opposed major faces and extending laterally beyond at least one of said major faces, said ledges accounting for at least 5 percent of the total projected area of said tabular grains having ledges.

* * * * *